US005813511A

United States Patent [19]

Takemoto et al.

[11] Patent Number: 5,813,511

[45] Date of Patent: Sep. 29, 1998

[54] SLOT MACHINE

[75] Inventors: Takatoshi Takemoto; Kenji Yamamoto, both of Taito-ku, Japan

[73] Assignee: Kabushiki Kaisha Ace Denken, Tokyo, Japan

[21] Appl. No.: 676,319

[22] PCT Filed: Jan. 12, 1995

[86] PCT No.: PCT/JP95/00030

§ 371 Date: Jul. 18, 1996

§ 102(e) Date: Jul. 18, 1996

[87] PCT Pub. No.: WO95/19208

PCT Pub. Date: Jul. 20, 1995

[30] Foreign Application Priority Data

Jan. 18, 1994 [JP] Japan ..... 6-003699

[51] Int. Cl.[6] ..... G07F 17/34

[52] U.S. Cl. ..... 194/217; 273/138.2; 463/25

[58] Field of Search ..... 194/215, 216, 194/217, 218, 219; 273/143 R, 138 A, 138.2; 364/412; 463/20, 25

[56] References Cited

U.S. PATENT DOCUMENTS

| | | | |
|---|---|---|---|
| 3,819,186 | 6/1974 | Hinterstocker | 273/138 A |
| 4,695,053 | 9/1987 | Vazquez, Jr. et al. | 273/143 R X |
| 5,010,995 | 4/1991 | Okada | 273/143 R X |
| 5,096,195 | 3/1992 | Gimmon | 364/412 X |
| 5,467,856 | 11/1995 | Okada | 194/202 |
| 5,531,440 | 7/1996 | Dabrowski et al. | 463/25 X |

FOREIGN PATENT DOCUMENTS

| | | | |
|---|---|---|---|
| 0164877 | 12/1985 | European Pat. Off. | 273/143 R |
| 37 38 121 A1 | 5/1989 | Germany . | |
| 41 21 984 A1 | 1/1993 | Germany . | |
| 63-54186 | 3/1988 | Japan . | |
| 63-102784 | 5/1988 | Japan . | |
| 1-138490 | 9/1989 | Japan . | |
| 3-39082 | 4/1991 | Japan . | |
| 3-41480 | 4/1991 | Japan . | |
| 2092797 | 8/1982 | United Kingdom | 273/143 R |
| 2 142 457 | 1/1985 | United Kingdom . | |

*Primary Examiner*—F. J. Bartuska
*Attorney, Agent, or Firm*—Seed and Berry LLP

[57] ABSTRACT

An object of the invention is to provide a slot machine eliminating operation of a start lever and specification of the number of medals to be bet. The number of medals to be bet is specified with a number-of-medals setting switch, which holds the setup state until it is next operated. If the number of medals input through a medal slot is equal to or greater than the number of medals set with the number-of-medals setting switch, a control section automatically starts a change display section for executing game play. Players can concentrate more on playing a game. On the other hand, for gaming houses, the operating efficiency of the slot machine also improves, resulting in an increase in sales.

3 Claims, 9 Drawing Sheets

$J_{(k)}$

| k | | | | | |
|---|---|---|---|---|---|
| 1 | 0 | 0 | 0 | 0 | 0 |
| 2 | 0 | 0 | 0 | 0 | 1 |
| ⋮ | | | ⋮ | | |
| 11 | 0 | 1 | 0 | 1 | 1 |
| 12 | 0 | 1 | 1 | 0 | 0 |

$P_{(x)}$

| x | ARRANGEMENT PATTERN | | | NO. OF DISPENSED MEDALS |
|---|---|---|---|---|
| 1 | 1 | 1 | 1 | $N_1$ |
| 2 | 2 | 2 | 2 | $N_2$ |
| 3 | 3 | 3 | 3 | $N_3$ |
| 4 | 4 | 4 | 4 | $N_4$ |
| ⋮ | | ⋮ | | ⋮ |

SLOT MACHINE

TECHNICAL FIELD

This invention relates to a slot machine eliminating the need for a start lever.

TECHNICAL BACKGROUND

A slot machine is one example of gaming machine played in gaming houses, casinos, etc.

The slot machine comprises, as shown in FIG. 11, a change display section 20' having three display windows 200'*a*, 200'*b*, and 200'*c*, which will be hereinafter collectively called "display windows 200'," for changing and displaying a plurality of provided symbols in a predetermined order. Changing of the display symbols is stopped in order as instructed by the player, and a predetermined number of medals are paid out to the player in response to the symbol arrangement and the number of bet medals when the display symbol changing stops completely.

When the player operates a start lever 100, changing of the display symbols on the change display section 20' is started on the three display windows 200' at the same time. The display symbol changing is stopped by operating three stop buttons 5'*a*, 5'*b*, and 5'*c*, which will be hereinafter collectively called "stop buttons 5," corresponding to the display windows 200'*a*, 200'*b*, and 200'*c* respectively. The changing of the display symbols on the display windows 200'*a*, 200'*b*, and 200'*c* is stopped at the timings at which the corresponding stop buttons 5'*a*, 5'*b*, and 5'*c* are pressed.

Therefore, the player plays games while repeating a sequence of steps of "inputting medals (specifying the number of medals to be bet)→operating the start lever→operating the stop buttons."

In addition, a slot machine of the type for previously accepting a large number of medals is also available. In this case, to specify the number of medals to be bet, the player operates a separately provided, dedicated switch each time. This dedicated switch is normally formed as a push button and the player can specify the number of medals to be bet by pressing the push button as many times as the number of medals to be bet. With such a slot machine, after inputting medals, the player repeats the steps of "operating the number-of-medals specification button"→operating the start lever→operating stop buttons."

DISCLOSURE OF INVENTION

Such slot machines are relatively old in concept, and in recent years, design improvements have mainly been in the area of the change display section 20, etc.

However, the present inventor found the following problems remaining unsolved as a result of completely examining how the slot machines currently developed are played:

[1] Start lever

In the above-mentioned playing sequence, operating the start lever has no effect on the game play result and is essentially unrelated to the game play contents. This means that the symbol combination at the stop time depends on operating the stop buttons, which is the essence of the game play. In contrast, the start lever is operated only to instruct the slot machine to start changing the display symbols. Therefore, operating the start lever is really nothing but an inconvenience for the player.

For the gaming houses, the presence of the start lever is an encumbrance reducing the substantial net operating rate of gaming machines. This means that the number of times a game play is executed within a given time with such a gaming machine is reflected directly in the sales. Therefore, to increase the sales, it becomes important to create a condition in which gaming machines are operated efficiently. Depending on the symbol arrangement result, the player may not immediately operate the start lever, although he or she actually wishes to continue playing a game. For example, if the player comes within an inch of a big win arrangement "777," but does not complete it finally, he or she may be late starting the next game play because of disappointment. The absolute length of the time loss (seconds) caused by such a factor is small in estimation for each game play.

However, in a slot game that the player takes several seconds to play, the ratio of the time loss to the substantial game play time is not small. Normally, one player plays a slot machine more than once before finishing of playing the slot machine. He or she continues to play for several tens of minutes or sometimes over several hours. Therefore, the time loss caused by such a factor is not negligible and is large with respect to the entire game play period. Resultantly, the sales are lowered.

Thus, the start lever does more harm than good for both the player and gaming house.

[2] Specification of the number of medals to be bet

In the slot machine, specification of the number of medals to be bet, which will be hereinafter called a bet figure, is the essence of game play. However, in actual fact, few players change the bet figure each time. Normally, each player plays a game while almost always betting the same number of medals, because basically there is not reason to change the bet figure in the slot machine where game plays are completely independent of each other, and the preceding game play result does not affect the following game play result. Each player simply determines the bet figure from tradeoffs of the number of medals on hand and the game play time, or merely his or her preferred number. Under the present circumstances, almost all players bet the maximum number of medals (generally, three medals) for playing a game. Therefore, the bet figure specification action is a relatively unimportant aspect of game play, and there is almost no reason to have it in the slot machine, from the point of view of both the player and gaming house, like the start lever.

Thus, the current slot machine has room for improvement for both the player and gaming house.

It is an object of the invention to provide a slot machine eliminating burdensome start lever operations.

It is another object of the invention to provide a slot machine eliminating the need for players to specify the number of medals to be bet, or to improve efficiency of such specifying.

To these ends, according to the invention, there is provided a slot machine comprising game play media detection means for accepting input of one or more game play media; a change display section comprising a plurality of kinds of display symbols provided and a plurality of display fields for displaying the symbols, the change display section for displaying one or more of the symbols in each of the display fields and enabling change of the displayed symbols to be started and then the change to be stopped for each display field; start means comprising a threshold value indicating the number of game play media used as the reference for starting a game play, the start means for counting the number of game play media accepted by the game play media detection means, subtracting the threshold value from the number of counted game play media for each game play (hereinafter, the calculation result will be referred to as a "credit count"), and comparing the credit count with the threshold value, and if the credit count is equal to or greater than the threshold value, the start means for causing the change display section to start change of display symbols; stop instruction means for accepting a stop instruction of symbol change for each of the display fields of the change display section and outputting a stop instruction of the display symbol change in the display field to the change display section; determination means for determining a win condition in a predetermined correspondence with the display symbols on the change display section, and dispensing means for dispensing game play media in response to the determination result of the determination means.

The determination means may comprise symbol detection means for detecting display symbols on the change display section and determining a win condition based on the detection result of the symbol detection means. The slot machine may further include instruction means for accepting an instruction for setting the threshold value, and the start means may set the threshold value in response to an instruction from the instruction means.

The start means may comprise a value defining a time interval between stopping change in all the display fields and again starting change on the change display section, which will be hereinafter referred to as a "start interval". The start means counts the time from the instance of stopping symbol change in all the display fields of the change display section, and if the credit count is equal to or greater than the threshold value and the time counted by the time count means exceeds the start interval, causes the change display section to start changing symbols.

It may be possible to change the start interval. The start means may comprise a function for detecting a time interval between one stop instruction and another accepted by the stop instruction means, and determining the start interval in response to the time interval in a given past range.

The function in the slot machine of the invention comprising the configuration described above will be discussed.

When the start means checks that the credit count is equal to or greater than the threshold value and that the start interval has elapsed, it causes the change display section to start changing display symbols.

When the stop instruction means accepts a stop instruction, the change display section stops changing the symbols.

The determination means determines a win condition in predetermined correspondence with the display symbols when the change display section stops the symbol change. To do this, for example, the display symbols when the change display section stops may be detected and a win condition may be determined based on the detected display symbols.

The dispensing means dispenses game play media in response to the determination result of the determination means.

The start means determines the start interval based on the stop instruction interval in a given past range.

As discussed above, the slot machine of the invention eliminates the need for the player to operate the start lever, etc., whereby the player can concentrate more on playing a game. For the gaming house, the operating efficiency of the slot machine also improves and sales can be increased. Further, for the slot machine manufacturer, the start lever requiring most durability becomes unnecessary, whereby the slot machine manufacturing cost can be decreased.

BEST MODE FOR CARRYING OUT THE INVENTION

Referring now to the accompanying drawings, there is shown one preferred embodiment of the invention.

Figure 1:
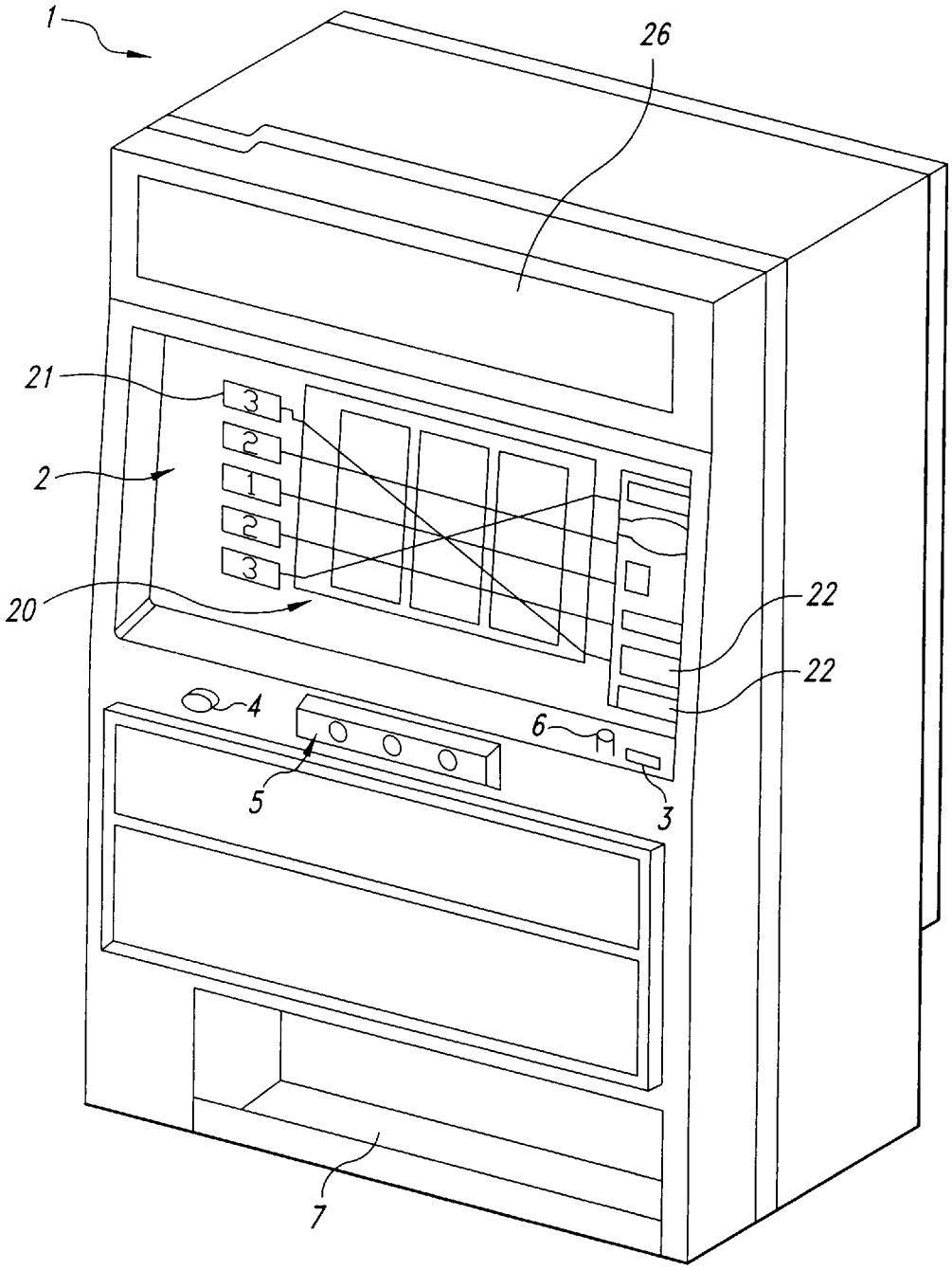
FIG. 1 is a perspective view of a slot machine of one embodiment of the invention.

FIG. 1 shows the appearance of a slot machine of the embodiment.

The slot machine 1 of the embodiment is substantially like a longwise rectangular parallelepiped and comprises a game play panel 2, a change display section 20 provided on the game play panel, a medal slot 3, a number-of-medals setting switch 4, stop buttons 5*a*, 5*b*, and 5*c*, a dispensing button 6, and a medal return 7 when seen from outside.

The game play panel 2 is a portion for actually playing a game. Glazed glass 21 is fitted over the entire surface of the game play panel 2. Various patterns and an explanatory note about game play are drawn on the glazed glass 21. The change display section 20 (described later) serving as the nucleus of game play is provided at the center of the game play section. Further, various counter-type displays 22, such as a display indicating the number of dispensed medals and a display indicating the number of input medals, are located on the right of the game play panel 2.

Figure 2:
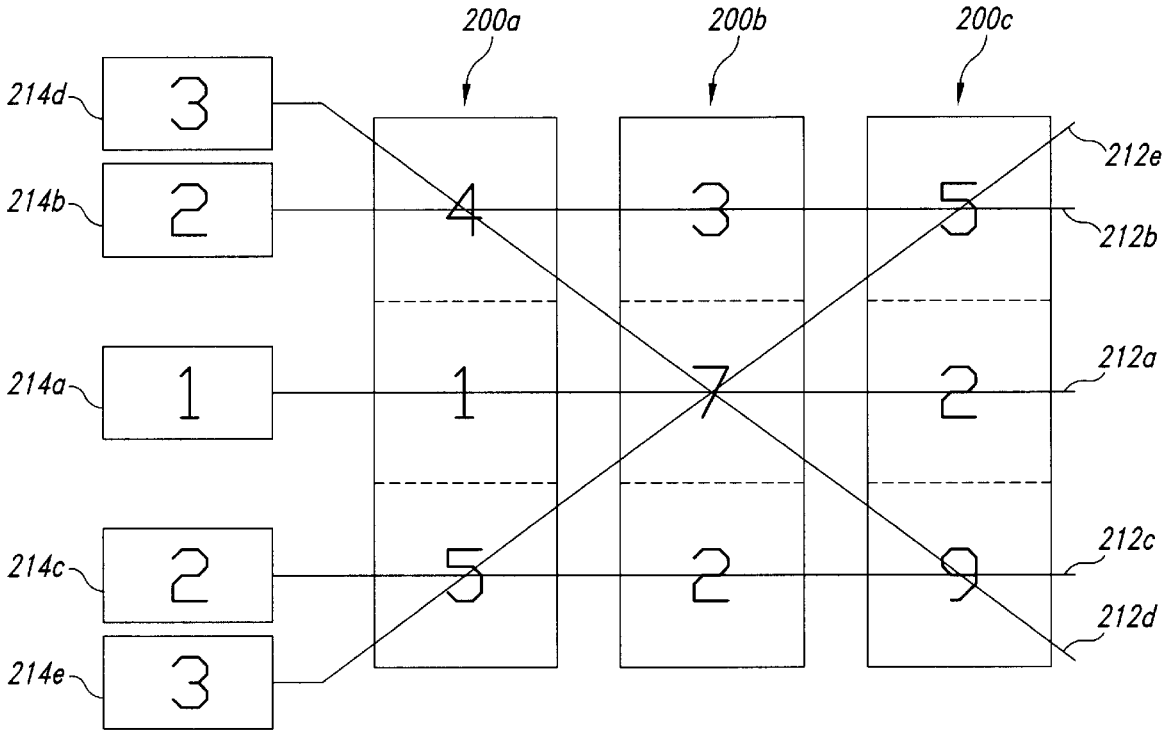
FIG. 2 is an enlarged view of a change display section 20.

As shown in FIG. 2, the change display section 20 comprises three display windows 200*a*, 200*b*, and 200*c* placed side by side. Three different kinds of symbols provided are displayed from the top to the bottom of each of the display windows 200*a*, 200*b*, and 200*c*. This means that nine symbols are displayed is an arrangement of three by three symbols on the entire change display section 20. The display symbols change while moving from top to bottom for each of the display windows 200*a*, 200*b*, and 200*c*. The detailed configuration of the change display section 20 will be discussed later.

Five symbol determination lines 212*a*, 212*b*, 212*c*, 212*d*, and 212*e*, which will be hereinafter collectively called "symbol determination lines 212", are drawn on the portions of the glazed glass 21 corresponding to the change display section 20. The symbol determination lines 212 are provided to explicitly show symbol strings, for which whether or not a win condition occurs is to be determined, to the player. The symbol determination lines 212*a*, 212*b*, 212*c*, 212*d*, and 212*e* are provided with number-of-medals indications 214*a*, 214*b*, 214*c*, 214*d*, and 214*e* to explicitly show the minimum number of bet medals required for determining whether or not a win condition occurs. In the example in FIG. 2, the symbol determination line 212*c* shows that whether or not a win condition occurs is determined for the symbol string 5, 2, 9. Unless at least two medals are bet, whether or not a win condition occurs is not determined for the symbol determination line 212*c* (in this case, the symbol string 5, 2, 9).

The medal slot 3 is a part for the player to input medals when starting to play a game. It communicates with a medal detector 30 described later (see FIG. 6) through a passage not shown in FIG. 1. The medals input to the medal slot 3 are led to the medal detector 30 through the passage.

Figure 3:
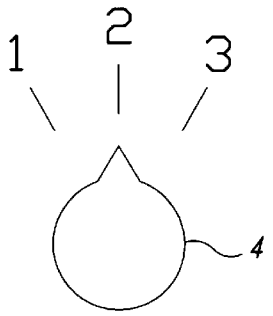
FIG. 3 is an illustration showing a number-of-medals setting switch 4.

The number-of-medals setting switch 4 is provided to accept a player's specification of the number of medals to be bet. As shown in FIG. 3, it is made of a rotary switch for selecting one from among the numbers of medals that may be bet (one, two, or three medals). The state of the number-of-medals setting switch 4 is held unless the player operates the switch 4 again. Thus, if the number of medals to be bet is not changed, the player need not operate the switch 4. The setup state of the number-of-medals setting switch 4 is output to a control section 8 described later.

The stop buttons 5*a*, 5*b*, and 5*c*, which will be hereinafter collectively called "stop buttons 5," are provided for the player to enter a change stop command for symbols on the change display section 20. In the embodiment, the stop buttons 5 are made of microswitches. The signals produced by the stop buttons 5 are output separately to the control section 8 described later. Thus, the control section 8 can determine which of the stop buttons 5*a*, 5*b*, and 5*c* has been operated. It treats operation of the stop button 5*a* as a stop command of a rotation drum 202*a* described below. Likewise, it treats operation of the stop buttons 5*b* and 5*c* as stop commands of rotation drums 202*b* and 202*c* described below.

The dispensing button 6 is provided for the player to give a command for returning medals input to the medal slot 3. It also plays a role in informing the slot machine of quitting the game play. Operation of the return button 6 is output to the control section 8 described later.

The medal return 7 is a part for storing dispensed or returned medals. Medals are dispensed by a dispensing mechanism 70 (see FIG. 6).

In addition, the slot machine 1 has parts provided with various decorating sections 26 for making the game play livelier.

Figure 4:
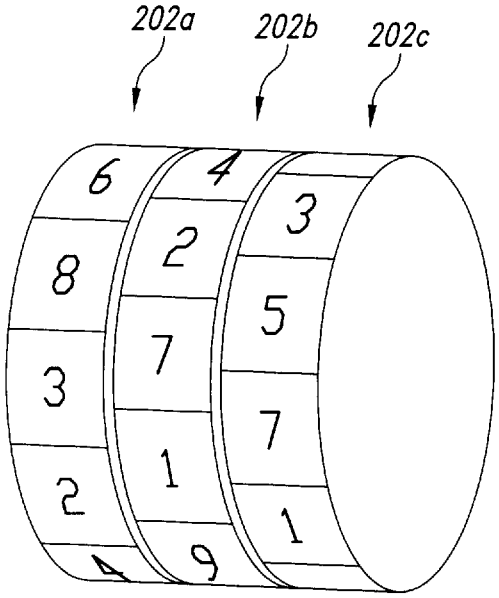
FIG. 4 is a perspective view showing rotation drums 202.

The change display section 20 will be discussed in detail with reference to FIGS. 4 and 5.

It comprises hollow rotation drums 202*a*, 202*b*, and 202*c*, which will be hereinafter collectively called rotation drums 202, placed in agreement with the positions of the display windows 200*a*, 200*b*, and 200*c* and motors for rotating the rotation drums 202 (not shown).

The outer peripheral surface of each rotation drum 202 is divided into 12 parts of equal arc, and predetermined symbols (in the embodiment, digits 1–12, to which the predetermined symbols are not limited) are drawn in the parts. For each rotation drum 202*a*, 202*b*, 202*c*, the three symbols positioned on the side of the display window 200*a*, 200*b*, 200*c* are seen through the display window 200*a*, 200*b*, 200*c* (see FIG. 2). The rotation drums 202 are rotated by the motors, etc., independently, whereby the display symbols are changed. The rotating speed of each of the rotation drums 202*a*, 202*b*, and 202*c* is not limited. Rotation of the rotation drums 202 is controlled by a change display control section 2020 (see FIG. 6).

Figure 5:
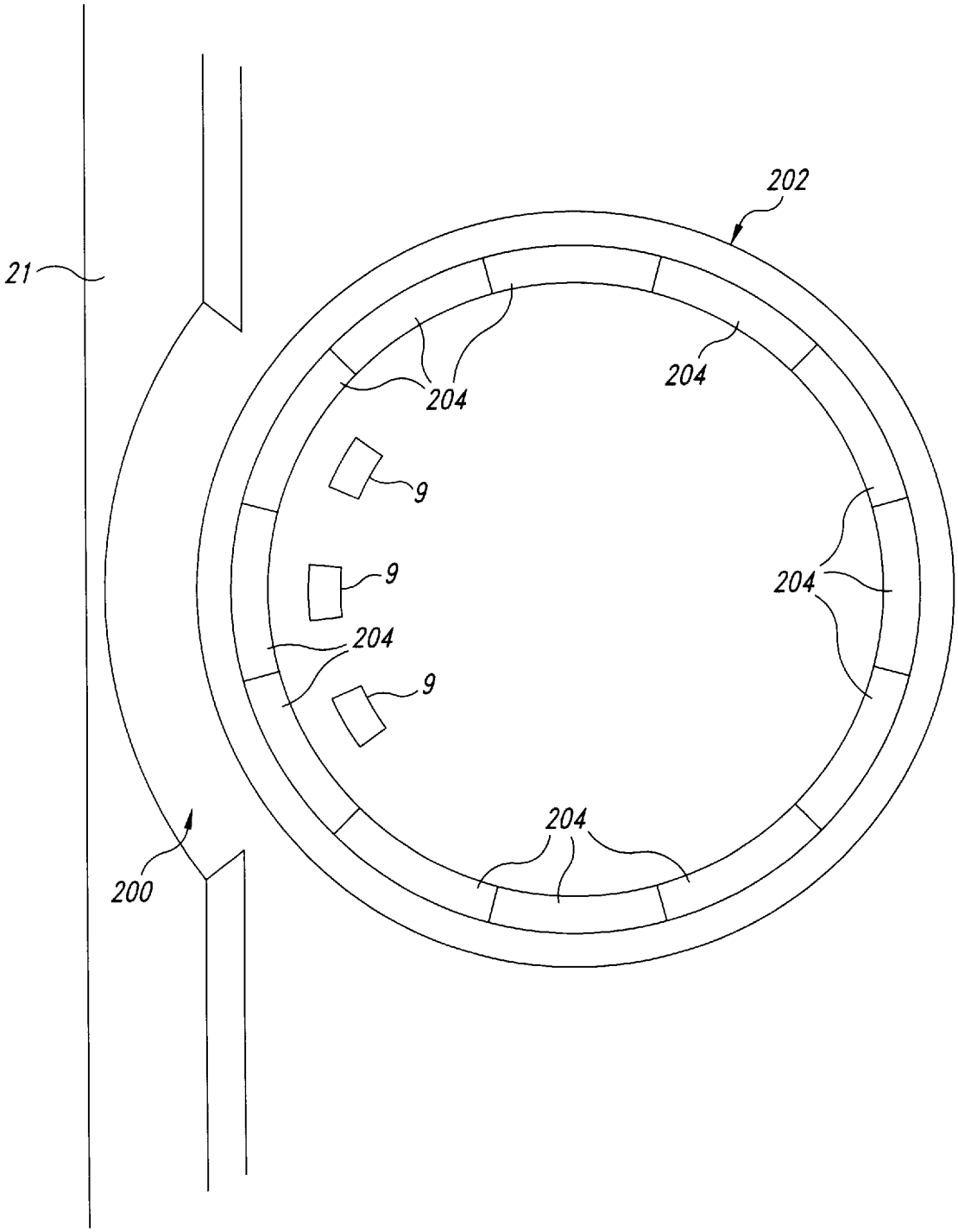
FIG. 5 is a schematic diagram showing the internal structure of the change display section 20.

As shown in FIG. 5, each rotation drum 202 is provided on its inner face with markers 204 corresponding to the positions of the symbols, and having code information indicating the kind of the symbol drawn on the front of the corresponding position being entered. Symbol detection sensors 9 are placed at predetermined angle positions and read the markers 204, thereby detecting the kind of symbol displayed on the display windows 200 and outputting the detected symbol kinds to the control section 8. In the embodiment, the markers 204 and the symbol detection sensors 9 are made of magnetic markers and magnetic sensors. However, the invention is not limited to them. For example, they may be made of bar codes and bar-code readers.

When the player inputs as many medals as the number of medals set with the number-of-medals setting switch 4, rotation of all the rotation drums 202 is started at once. On the other hand, the rotation drums 202*a*, 202*b*, and 202*c* are stopped separately at the timings at which the player operates the stop buttons 5*a*, 5*b*, and 5*c*. The rotation drums 202 are always started and stopped based on instructions from the control section 8 described later.

In the embodiment, the change display section 20 is provided mechanically, but its specific composition is not limited. For example, a CRT may be used to provide the change display section 20 as images on a display screen. In this case, the symbol arrangement on each rotation drum 202 may also be changed each time.

Figure 6:
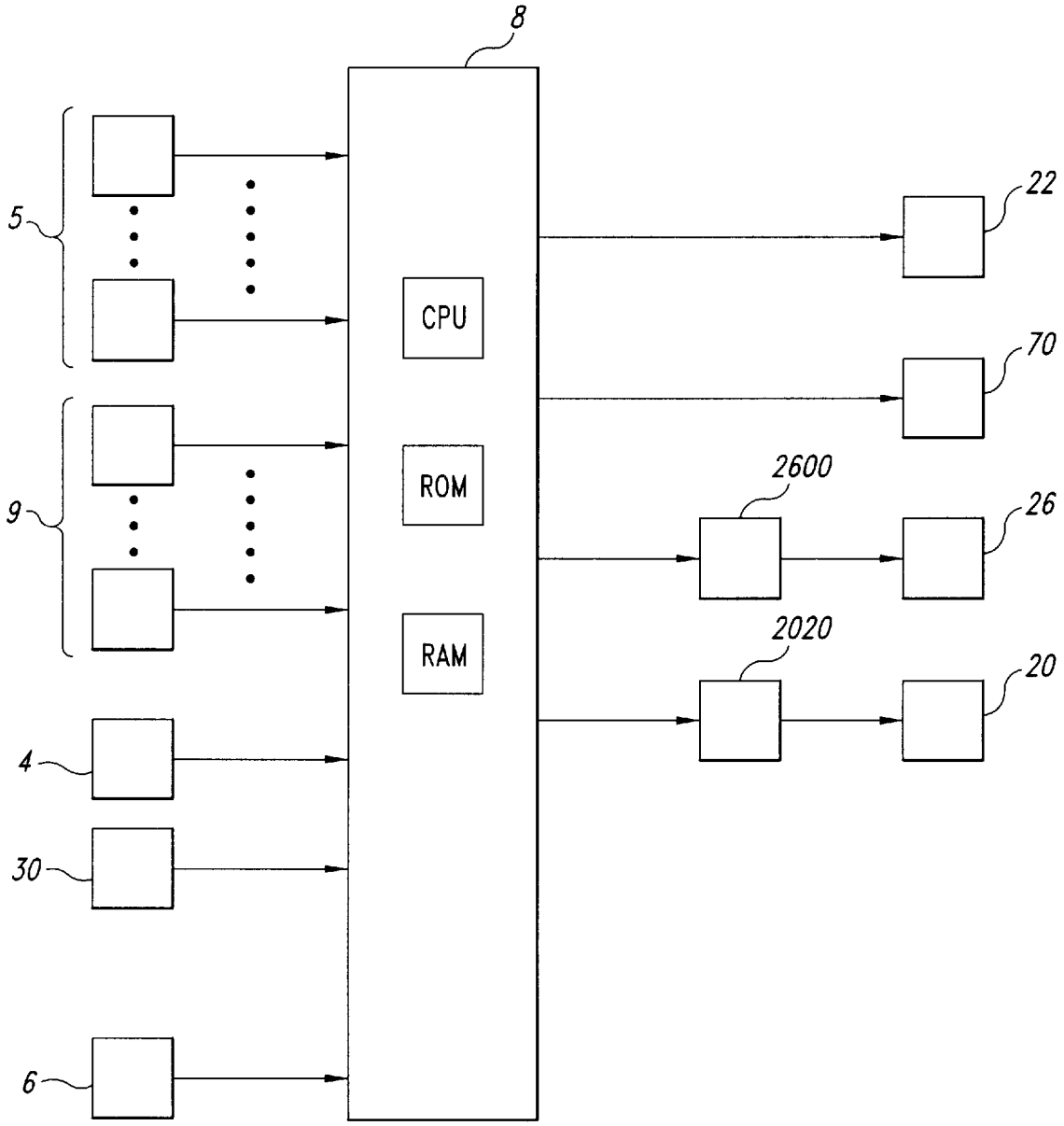
FIG. 6 is a block diagram showing the control configuration.

Next, the control configuration of the slot machine will be discussed with reference to FIG. 6.

The slot machine is controlled by circuitry comprising the medal detector 30, the number-of-medals setting switch 4, the stop buttons 5, the symbol detection sensors 9, the change display control section 2020 for driving the change display section 20, the dispensing mechanism 70 for dispensing medals, a decoration control section 2600 for controlling a decoration section 26 for producing decoration lighting and sound effect, and the control section 8 for controlling the entire slot machine. The medal detector 30 detects a medal input to the medal slot 3 and determines the validity of the input medal. The detection and determination results are output to the control section 8.

The number-of-medals setting switch 4, the stop buttons 5, the return button 6, the symbol detection sensors 9, etc., are as already described.

The control section 8 controls the various sections. In the embodiment, it comprises electrical circuitry of a microcomputer, memory, etc., and programs and data stored in the memory. Particularly, the control section 8 in the embodiment has a function of automatically causing the change display section 20 to start changing display symbols if it acknowledges that a predetermined number of medals or more are input through the medal slot 3. Further, the control section 8 has a function of ascertaining how the stop buttons 5 were operated in the past and automatically adjusting the time interval between the change display section 20 stopping symbol change and starting symbol change again (start interval T described later). It also has a timer function required for such time control.

Figures 7A, 7B, 7C:
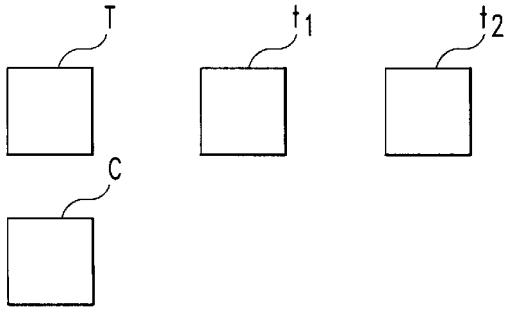
FIGS. 7*a*, 7*b*, and 7*c* are illustrations showing data in a control section 8.

In addition, the control section 8 has a function being responsive to operation of the stop button 5 for stopping rotation of the rotation drum 202 corresponding to the operated stop button 5 as conventionally, and a function of detecting the kind of display symbols at the drum stop time and determining whether or not a win condition occurs for the display symbols. The symbol is detected by collating the detection result of the symbol detection sensor 9 with the code information J (k) indicating the symbol kind described on the marker 204. To determine whether or not a win condition occurs, whether or not the arrangement of the three symbols displayed on the symbol determination line 212 for which the determination is to be made matches a predetermined arrangement P (x), hereinafter simply a win pattern P (x), is determined. This determination is made for each of the currently active symbol determination lines 212. Further, the control section 8 has a function of outputting an instruction to the dispensing mechanism 70 so that the dispensing mechanism 70 dispenses a predetermined number of medals in response to the winning condition of the determination result. The control section 8 has a memory previously storing the code information J (k: 1–12), win patterns P (x), the number of dispensed medals Nx for each win pattern, etc. FIGS. 7*a*, 7*b*, and 7*c* show an example of the information contained in the control section 8.

The code information J (k) and the win patterns P (x) are previously stored in the memory in the control section 8. Further, areas for storing the start interval T, measurement values t (1) and t (2), and a credit count C are provided in the memory. The correspondence between the symbol types and their code information is described in the code information J (k). The correspondence between the code information arranged corresponding to each win pattern (Note: In FIGS. 7*a*, 7*b*, and 7*c*, symbol kinds are listed) and the number of dispensed medals Nx is described in the win pattern P (x). Symbol arrangements not contained in the win patterns P (x) are losses. The contents of the code information J (k) and the win patterns P (x) are fixed and are not rewritten.

The meanings of the start interval T, measurement values t (1) and t (2), and credit count C will be described in the operation description. The values thereof are updated each time the player plays a game.

The functions of the control section 8 will be discussed in detail later, together with the operation description.

The counter-type displays 22, the change display control section 2020, the dispensing mechanism 70, and the decoration control section 2600 operate in accordance with instructions from the control section 8. "Game play media" mentioned in the claims are equivalent to medals in the embodiment; "change display section" is equivalent to the change display section 20, the change display control section 2020, etc., in the embodiment; "game play media detection means" is equivalent to the medal detector 30 and the control section 8 in the embodiment; "start means" and "determination means" are equivalent to the control section in the embodiment; "symbol detection means" is provided by the symbol detection sensors 9 and the control section 8; "stop instruction means" is provided by the stop buttons 5 and the control section 8; "dispensing means" is equivalent to the dispensing mechanism 70; and "display fields" are equivalent to the display windows 200. However, the parts operate in close conjunction with each other and the correspondence therebetween described here is not strict.

Figure 8:
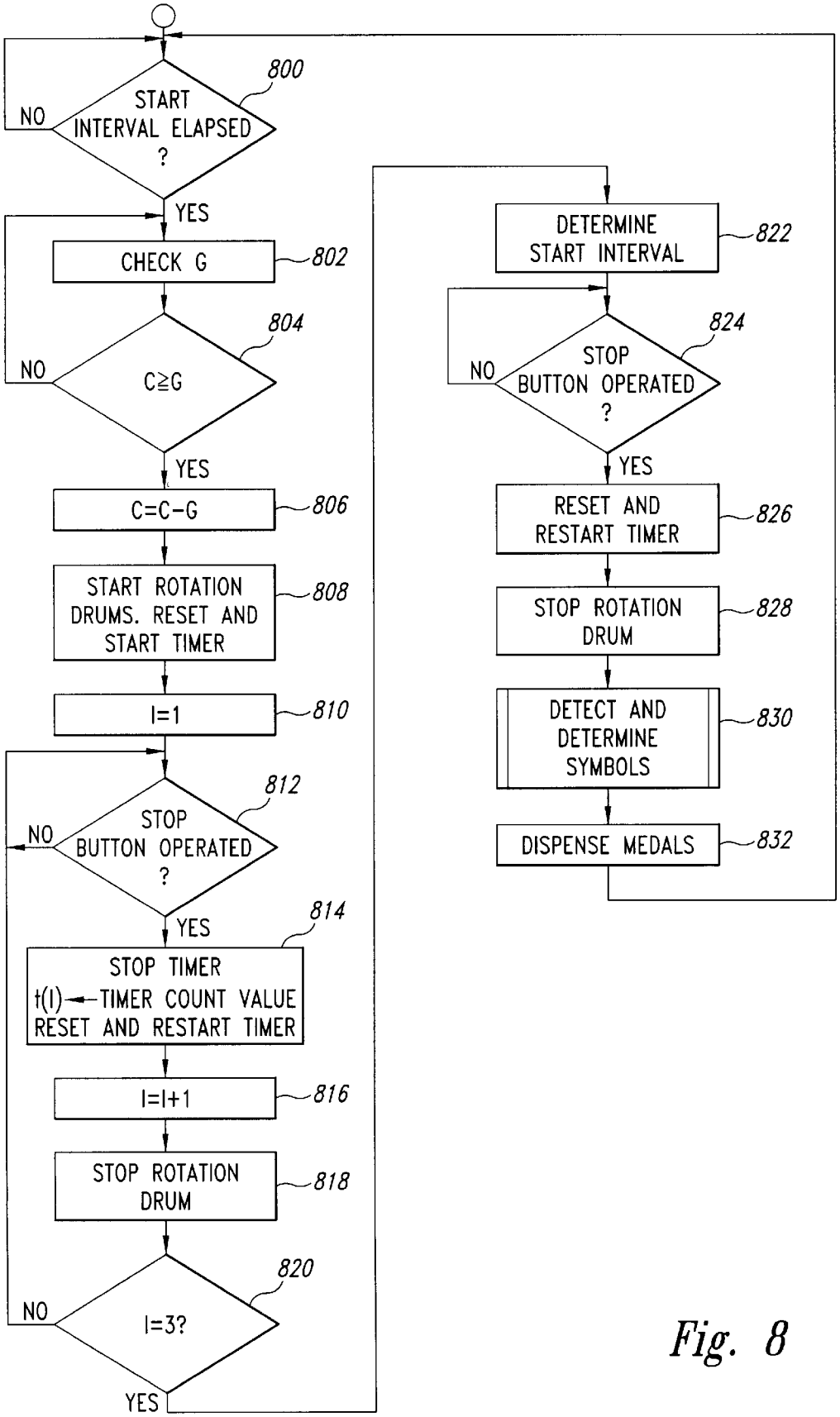
FIG. 8 is a flowchart showing the operation of the control Section 8.

Next, the operation of the slot machine of the embodiment will be discussed with a flowchart in FIG. 8. In the description that follows, the setup value of the number-of-medals setting button 4 is referred to as the "bet figure G" and the number of medals input through the medal slot 3, but not spent for game play is referred to as the "credit count C."

Just after the operation starts, first the control section 8 continues a standby state while repeating a determination as to whether or not the start time T has elapsed at step 800. This step is effective when the same player repeats playing a game and has no have substantial function just after a new player starts playing a game. The determination at step 800 almost always becomes Yes just after a new player starts playing a game.

If the start interval T has elapsed at step 800, the control section 8 detects the setup state of the number-of-medals setting button 4 and checks the bet figure G at step 802. It determines whether or not the credit count C is equal to or greater than the bet figure G at step 804. Each time a medal is input to the medal slot 3, an interrupt routine described later (see FIG. 9) is started for updating the credit count C.

If the credit count C is less than the bet figure G as a result of the determination at step 804, the control section 8 returns to step 802 and repeats the step.

On the other hand, if the credit count C is equal to or greater than the bet figure G at step 804, the control section subtracts the bet figure G from the credit count C and causes the predetermined counter-type display 22 to display a new credit count C at step 806. After this, it sends an instruction to the change display control section 2020 for starting rotation of all the rotation drums 202*a*, 202*b*, and 202*c* at once. At the same time, the control section 8 resets and starts the timer at step 808 and initializes control variable I to 1 at step 810. The time count operation and initialization of the control variable I are performed for detecting the operating interval of the stop buttons 5.

After this, the control section 8 continues in a standby state until the player operates any stop button 5 at step 812. When acknowledging that the stop button 5 has been operated, the control section 8 stops the timer and assigns its count value (time) to t (I) in the memory. Further, it resets the timer, then again starts counting the time at step 814. After this, the control section 8 adds one to the control variable I at step 816 and sends an instruction to the change display control section 2020 for stopping rotation of the rotation drum 202 corresponding to the stop button 5 operated at the time at step 818.

Subsequently, the control section 8 determines whether or not the control variable I has reached three, namely, whether two stop buttons 5 have already been operated, at step 820. If the determination result at step 820 is NO, namely, only one stop button 5 has been operated, the control section 8 returns to step 812 and again repeats the steps. Thus, steps 814–820 are repeated twice, whereby the time between starting the rotation drums 202 and the first stop button 5 operation is stored in t (1) and the time between the first stop button 5 operation and the second stop button 5 operation is stored in t (2).

If the determination result at step 820 is YES, the control section 8 determines the start interval T based on the present and past stop button 5 operating intervals. The start interval T mentioned here refers to the time between stopping the last rotation drum 202 (strictly speaking, step 826 described later) and starting the rotation drums 202 in the next game play (strictly speaking, step 808). In the embodiment, the start interval T is determined according to the following calculation expression:

$$T = 9 \times Ta + \frac{t(1) + t(2)}{2} \tag{1}$$

where Ta is the start interval calculated last time.

This calculation is substantially to average t (1), t (2) in the ten past game plays. The calculated start interval T becomes Ta in the next calculation.

Subsequently, the control section 8 enters a standby state until the third stop button 5 is operated at step 824. When acknowledging that the third stop button 5 has been operated, the control section 8 resets the timer, then again starts counting the time at step 826, and stops rotation of the last rotating rotation drum 202 at step 828. Since the operations executed by the control section 8 are sufficiently fast, an event hardly ever occurs wherein the player operates the last stop button 5 while the control section 8 is calculating the start interval T. The same can be said of any other processing.

After this, the control section 8 compares the detection signals of the symbol detection sensors 9 with the code information J (k) in sequence, thereby detecting the kinds of display symbols. Further, it compares the symbol string, which is the object of detection, with the win pattern P (x), thereby determining whether or not a win condition occurs for the symbol string at step 830. The win condition determination is executed once when the bet figure G=1, three times when the bet figure G=2, or five times when the bet figure G=3.

Finally, the control section 8 dispenses a predetermined number of medals (Nx medals) according to the win condition determination result, and completes one game play at step 832. After this, the control section 8 again returns to step 800 at which it waits for a lapse of the start interval T determined last time at step 822. When the start interval T has elapsed, if the credit count C is equal to or greater than the bet figure G, rotation of the rotation drums 202 is automatically started.

Although not mentioned in the description made so far, the control section 8 sends an instruction to the decoration control section 2600 whenever required in response to the win condition, etc., for turning on the decoration section 26 to make livelier game play atmospheres.

Figure 9:
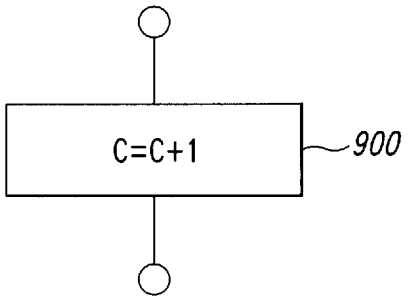
FIG. 9 is a flowchart showing an interrupt service for updating a credit count.

Next, an interrupt service executed by the control section 8 when a medal is input will be discussed with reference to a flowchart in FIG. 9.

When acknowledging that a medal is input based on an output from the medal detector 30, the control section 8 increments the credit count C by one at step 900. Each time a medal is input, the interrupt service is executed. Therefore, if the player inputs a medal at any time while playing a game, the slot machine can deal with it.

Figure 10:
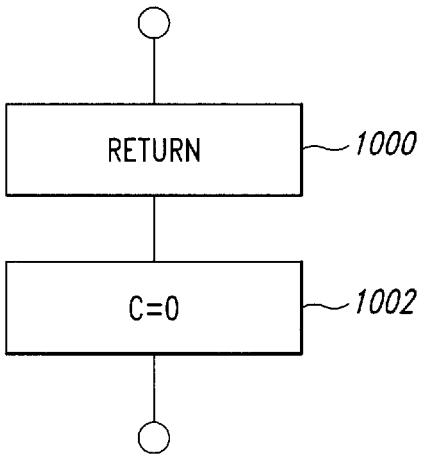
FIG. 10 is a flowchart showing an interrupt service for returning medals.
Figure 11:
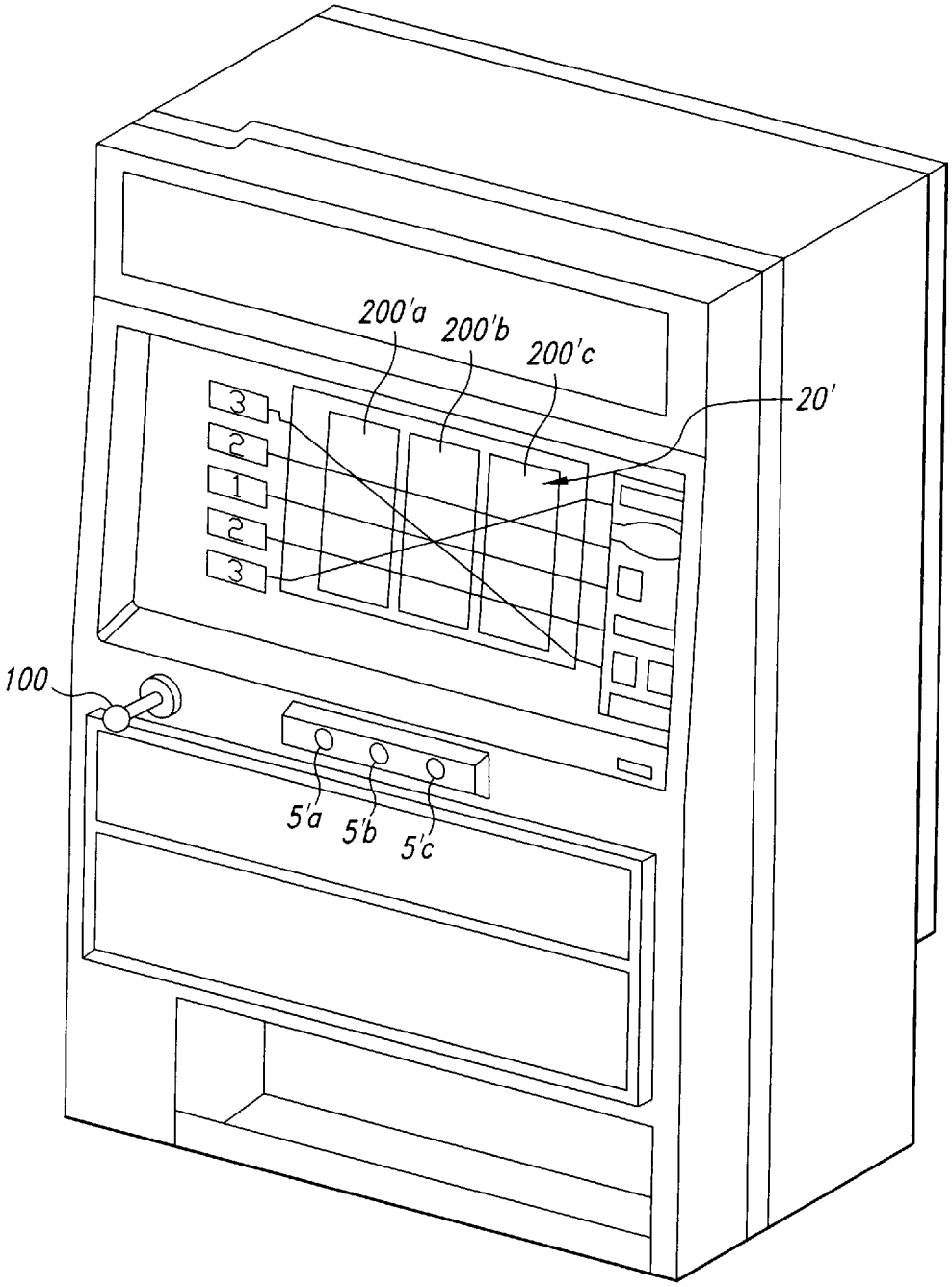
Fig. 11 (PRIOR ART)
FIG. 11 is a perspective view of a conventional slot machine.

Next, an interrupt service executed by the control section 8 when the player operates the return button 6 while playing a game will be discussed with reference to a flowchart in FIG. 10.

When sensing that the return button 6 has been operated, the control section 8 sends an instruction to the dispensing mechanism 70 for dispensing, to the medal return 7, as many medals as the number of medals equivalent to the current credit count C at step 1000. At the same time, it resets the value of the credit count C in the memory and also sets the indication on the counter-type display 22 to 0 at step 1002.

If the start interval T becomes too long, the net operating rate of the slot machine is lowered all the more. Therefore, the start interval T may be adjusted only within a predetermined range. If no game is played for a long time, it is assumed that games played by the same player are over, and the start interval T may be automatically set to a predetermined standard value. In doing so, the start interval calculated in response to the previous player using the slot machine does not affect game play of the next player of the slot machine. This is convenient for a player who plays a game after a player pressing the stop buttons 5 extremely rapidly or slowly.

In the embodiment, the start interval T is determined based on the first and second operating timings of the stop buttons 5 and the third operation timing is not considered, because the third operation timing is affected by the display symbol contents on the rotation drums 202 already stopped. This means that if a win condition can occur depending on the display symbol on the last rotating rotation drum, the player becomes careful and delays operating the third stop button 5. On the other hand, if there is no possibility that a win condition may occur, the player gives up the game and operates the third stop button 5 at once. However, the third stop button 5 operating timing may also be considered to determine the start interval T. The specific determination method (calculation method) is not limited to that shown in Expression 1. Further, the start interval calculation timing is not limited to that shown in the flowchart in FIG. 8 either.

As we have discussed, the slot machine of the embodiment eliminates the need for the player to perform troublesome operations such as operating the start lever and specification of the bet figure each time, so that the player can concentrate more on playing a game.

In game play in which the player repeats monotonous operations, as with the slot machine, he or she plays a game while maintaining a given rhythm particular to that player (probably related to his or her personality). Thus, to make the player continue playing games, it is important to make him or her maintain his or her rhythm. With some conventional slot machines, if the player operates the start lever, there are times where the rotation drums do not start, thus disrupting the player's rhythm. For example, such an event occurs if the start lever is in a defective condition or the player is not accustomed to operating the start lever. Further, the time interval between the player operating the start lever and the rotation drums actually starting rotation may not fit the rhythm of the player. In such a case, the player's rhythm is also disrupted. However, the slot machine of the embodiment would solve such problems and enable the player to always concentrate on playing a game.

Such an effect is further enhanced by eliminating the need for the player to specify the number of medals to be bet (bet figure G) each time. As already described, such players changing the bet figure each time do not actually exist. Thus, if a once setup bet figure is held intact unless it is changed, as in the embodiment, no disadvantages actually occur. Under the present circumstances, almost all players bet the maximum number of medals (generally, three medals) for playing a game, and thus the bet figure G may be previously fixed to a given number of medals, such as three. In doing so, the number-of-medals setting button 4 also becomes unnecessary, so that the slot machine manufacturing cost can be furthermore reduced. It is also made possible to easily start the slot machine even if the number of medals is one for a time, in response to the win condition determination result.

In addition, the slot machine of the embodiment also facilitates additional input of medals while the player is playing a game. Further, it also enables the player to leave the slot machine for a short time. Thus, if the remaining credit count C becomes small, the player can also go to a medal lending machine to borrow additional medals before he or she spends all medals on hand. Therefore, the possibility that the player will stop playing games with the slot machine as a chance when he or she spends all medals is lessened. On the other hand, the slot machine of the embodiment is also effective for the gaming house. While the time required for one game play is shortened, the time for one player to continue playing games can be prolonged, namely, the number of times the player plays a game can be increased. Therefore, both the operating efficiency of the slot machine and sales can be raised. This also results in an increase in the upper limit of sales for each slot machine.

Since the start lever has a high possibility of intensive use as compared with the stop buttons, etc., a costly lever having excellent durability must be used. This is because if the player's rhythm described above does not fit the slot machine operation timing, some players are irritated and pound the start lever when operating. However, the slot machine of the embodiment eliminates the need for such a start lever, whereby the manufacturing cost of the slot machine can be reduced. If the bet figure is fixed and the number-of-medals setting switch is removed, the manufacturing cost of the slot machine can also be further decreased. Further, if the bet figure is fixed, the need for drawing the number-of-medals indication 214 for each symbol determination line 212 is eliminated, thus increasing design flexibility of the game play panel 2. To slot machines where decorative designs plays an important role, this effect is important.

The invention can be applied not only to slot machines using medals, but also to those using pachinko (Japanese pinball) balls.

We claim:

1. A slot machine for accepting input of game play media and executing a game play, said slot machine comprising:

a change display section having a plurality of symbol sets each of which has a plurality of symbols, the change display section for displaying symbols and for changing symbols to be displayed in each of the symbol sets;

dispensing mechanism for dispensing game play media in response to a dispensing instruction;

a game play media detector for detecting the input game play media;

a stop instruction section for accepting an instruction from a user to stop a change display of symbols said stop instruction section having a plurality of stop buttons corresponding to a number of plurality of symbol sets; and a control section for controlling an operation of said change display section and said dispensing mechanism; wherein said control section executes a setting operation for setting a start interval as a time interval between a time when the change display has stopped in said change display section and a time when the change display starts again;

a monitoring operation for monitoring whether or not the start interval elapses after the change display of said change display section stops;

a calculating operation for finding the number of game play media detected by said game play media detector and for finding a credit count equivalent to the number of game play media available for game play based on the number of game play media detected by said game play media detector and the number of game play media spent for the game play;

a first determining operation for determining whether or not the credit count is equal to or greater than a predetermined threshold value;

a starting operation, when the credit count is determined equal to or greater than the predetermined threshold value, for giving a start instruction to said change display section in a case where the monitored start interval has elapsed;

a stop operation for accepting a stop instruction from said stop instruction section for causing said change display section to stop, and for giving said stop instruction to said change display section;

a second determining operation for determining, when the change display has stopped, whether or not a combination of displayed symbols each of which is one of said plurality of symbols in said symbol sets is a predetermined win condition; and a dispensing operation for giving said dispensing instruction to said dispensing mechanism for dispensing a predetermined number of game play media when the combination is determined to be the win condition; and wherein said control section sets a length of the start interval for the next play based on an average of a time period since the change display of the symbol sets in said change display section starts until said control section accepts the stop instruction from one of the stop buttons, a time period since said control section accepts the stop instruction from the one of the stop buttons until said control section accepts another stop instruction from another one of the stop buttons and at least a start interval currently being used.

2. The slot machine as claimed in claim 1 wherein in the calculation for finding a credit count, said control section subtracts the threshold value from the sum of the current credit count and the number of newly input game play media to find a new credit count.

3. The slot machine as claimed in claim 1 further including a switch for accepting setting of the threshold value, wherein said control section uses the threshold value set with said switch to calculate the credit count.

* * * * *